US007119053B2

(12) United States Patent
Jordan et al.

(10) Patent No.: US 7,119,053 B2
(45) Date of Patent: Oct. 10, 2006

(54) WHEEL AND TIRE CLEANER COMPOSITION COMPRISING AN ETHOXYLATED QUATERNARY AMMONIUM SURFACTANT

(75) Inventors: Elsie A. Jordan, Temecula, CA (US); Wen-Chen Su, Lexington, KY (US); Richard J. Baumgart, Paris, KY (US); Frances E. Lockwood, Georgetown, KY (US)

(73) Assignee: Ashland Licensing and Intellectual Property, LLC, Lexington, KY (US)

( * ) Notice: Subject to any disclaimer, the term of this patent is extended or adjusted under 35 U.S.C. 154(b) by 29 days.

(21) Appl. No.: 10/706,528

(22) Filed: Nov. 12, 2003

(65) Prior Publication Data

US 2004/0097390 A1 May 20, 2004

Related U.S. Application Data

(63) Continuation-in-part of application No. PCT/US02/35393, filed on Nov. 5, 2002.

(60) Provisional application No. 60/333,279, filed on Nov. 16, 2001.

(51) Int. Cl.
*C11D 1/835* (2006.01)
*C11D 3/08* (2006.01)
*C11D 3/28* (2006.01)

(52) U.S. Cl. ..... 510/189; 510/289; 510/290; 510/330; 510/400; 510/421; 510/427; 510/432; 510/480; 510/500; 510/504; 510/511

(58) Field of Classification Search ..... 510/189, 510/400, 421, 427, 432, 480, 504, 289, 290, 510/330, 500, 511
See application file for complete search history.

(56) References Cited

U.S. PATENT DOCUMENTS

| | | | | |
|---|---|---|---|---|
| 3,962,151 | A | 6/1976 | Dekker et al. | |
| 4,348,292 | A * | 9/1982 | Ginn | 510/406 |
| 4,670,171 | A | 6/1987 | Magyar | |
| 4,690,779 | A * | 9/1987 | Baker et al. | 510/433 |
| 4,895,675 | A | 1/1990 | Smith | |
| 5,399,205 | A | 3/1995 | Shinohara et al. | |
| 5,470,500 | A | 11/1995 | Lupyan et al. | |
| 5,507,969 | A | 4/1996 | Shinohara et al. | |
| 5,556,833 | A | 9/1996 | Howe | |
| 5,700,312 | A | 12/1997 | Fausnight et al. | |
| 5,726,139 | A * | 3/1998 | Willey et al. | 510/181 |
| 5,731,279 | A * | 3/1998 | Pancheri | 510/340 |
| 5,733,377 | A | 3/1998 | Howe | |
| 5,759,980 | A * | 6/1998 | Russo et al. | 510/241 |
| 5,866,532 | A | 2/1999 | Jackson et al. | |
| 5,871,590 | A | 2/1999 | Hei et al. | |
| 5,929,004 | A | 7/1999 | Ushijima et al. | |
| 5,955,415 | A | 9/1999 | Gutierrez et al. | |
| 5,955,419 | A * | 9/1999 | Barket et al. | 510/507 |
| 6,048,830 | A * | 4/2000 | Gallon et al. | 510/349 |
| 6,090,767 | A | 7/2000 | Jackson et al. | |
| 6,106,828 | A | 8/2000 | Bisgard-Frantzen et al. | |
| 6,221,433 | B1 | 4/2001 | Muntz et al. | |
| 6,221,833 | B1 | 4/2001 | Colurciello, Jr. | |
| 6,333,299 | B1 * | 12/2001 | Pace et al. | 510/238 |
| 6,484,735 | B1 * | 11/2002 | Gordon et al. | 134/25.2 |
| 6,551,985 | B1 * | 4/2003 | Bianchetti et al. | 510/475 |
| 6,562,142 | B1 * | 5/2003 | Barger et al. | 134/6 |
| 6,610,645 | B1 * | 8/2003 | Pancheri et al. | 510/509 |
| 6,718,992 | B1 * | 4/2004 | Cardola et al. | 134/25.2 |

FOREIGN PATENT DOCUMENTS

| | | |
|---|---|---|
| FR | 2692278 | 12/1993 |
| JP | 252499 | 10/1995 |

* cited by examiner

*Primary Examiner*—Charles Boyer
(74) *Attorney, Agent, or Firm*—Carrithers Law Office, PLLC; David W. Carrithers

(57) ABSTRACT

An aqueous wheel cleaning solution for removing the dirt form the surface of aluminum, chrome, stainless steel, painted steel, painted aluminum, clear coated aluminum, rubber, and plastic wheels and tires without scrubbing by applying the cleaning solution to the wheel and/or tire then rinsing the wheel and/or tire with water. Selected polymers include a polyvinylpyrrolidone, a poly(N-vinylimidazole, a poly(4-vinylpyridine-betaine), and/or a poly(4-vinylpyridine-N-oxide) each one of which can be used with conventional wheel cleaning components such as an acid or alkaline-based cleaning formulation to dramatically improve its wheel cleaning power. These polymers can attach to organic and inorganic dirt particles forming a complex with them for easy removal from the wheel and/or tire during rinsing, leaving the wheel and/or tire clean without scrubbing the wheel or tire surface.

64 Claims, No Drawings

WHEEL AND TIRE CLEANER COMPOSITION COMPRISING AN ETHOXYLATED QUATERNARY AMMONIUM SURFACTANT

This application is a continuation-in-part PCT/US02/35393 filed on Nov. 5, 2002 and U.S. Provisional application 60/333,279 filed on Nov. 16, 2001 each one of which are incorporated by reference herein in its entirety.

BACKGROUND OF THE INVENTION

1. Technical Field

This invention relates to an automotive wheel and/or tire cleaning composition for removing the dirt normally found on wheels and/or tires by spraying on and hosing off with water without scrubbing the wheel and/or tire surface.

2. Description of the Prior Art

Since an automobile is a significant personal investment, many people like to keep their automobiles clean and shiny with a minimum amount of effort, to help maintain the value of their investment. The wheels are part of the automobile that requires regular washing and cleaning to maintain the best appearance. There are various designs of wheels and some of those designs have areas that are hard to reach during the cleaning process. In order to help speed up the automobile cleaning process, there is a need for a wheel cleaner that can clean the wheel by spraying on the wheel cleaner, and then rinse off with water, resulting in a clean wheel without actually touching the wheel.

This invention relates to an automotive wheel cleaning composition for removing the dirt normally found on wheels by spraying on and hosing off with water without scrubbing the wheel surface. Since the wheel is mounted on an automobile and encounters a variety of environmental conditions, the dirt that accumulates on the wheels, is a combination of road soil and brake dust. Road soil is a complicated composition that can vary from location to location. Road soil can be divided into organic, which includes mineral oil, vegetable oil, animal fat, etc. and inorganic, which includes dust, dirt and other minerals. Brake dust is an accumulation of very fine participles of carbon black, graphite, metal, etc. that is the residue from the brake pad wearing on the brake disk. The basic composition of brake pads is polymer resins, inorganic fillers, metal particles, etc. Brake pad compositions are guarded secrets by manufacturers and vary by type of resin, fillers, metals and ratios depending on the intended service. Because of the complexity of road soil and brake dust, the material to be cleaned from each vehicle wheel varies every time it is cleaned. Another factor that needs to be considered for cleaning wheels is the material of construction of the wheel. This will affect the bonding force between the dirt and the wheel, which impacts the wheel cleaning performance. In general, the bond between the dirt and the wheel surface is not permanent and the basic type of affinity is Van de Waal force, hydrogen bonding, static electricity, etc.

There are varieties of wheel cleaners on the market, which are either acid or alkaline formulations. However, these products still have cleaning deficiency issues when they are sprayed on and hosed off. The concept of traditional cleaning detergent is to use lipophilic chain of surfactants, ionic and/or non-ionic, to adhere and penetrate the soil layer then detach soil from the wheel surface. In these typical cleaning detergent formulations, builders are used to help surfactants remove dirt and enhance surfactant performance on soil removal. Chelating agents such as ethylenediaminetetraacetic acid ("EDTA") are used to complex with metal ions to improve cleaning efficiency. However, the cleaning power is still not strong enough to remove all the dirt when these cleaners are sprayed on and hosed off.

For example, a wheel cleaning formulation is taught in U.S. Pat. No. 5,733,377 which discloses the use of an acid fluoride salt in wheel cleaning formulations to enhance the cleaning performance. The acid fluoride salt can present a hazardous issue in that it can in some cases result in toxicity of the formulation.

SUMMARY OF THE INVENTION

The cleaning composition of the instant invention is formulated specifically for wheels which are fabricated from materials which may be susceptible to damage from corrosive products; however, all of the compositions set forth in the instant application cleans tires as well.

The present invention provides an aqueous wheel and tire cleaning solution for removing the dirt form the surface of aluminum, chrome, stainless steel, painted steel, painted aluminum, clear coated aluminum and plastic wheels, and/or rubber tires without scrubbing by applying the cleaning solution to the wheel then rinsing the wheel with water. Moreover, the solution may be used on hubcaps or other vehicle exterior parts such as chrome grills, painted fiberglass, rubber, and painted elastomer and plastic bumpers as well. Preferred amphiphilic polymers utilized in the present invention are a polyvinylpyrrolidone, a poly(4-vinylpyridine-betaine), a poly(N-vinylimidazole, and/or a poly(4-vinylpyridine-N-oxide) used alone or in combination together with conventional wheel cleaning components such as an acid or alkaline-based formulation. The composition of the instant invention dramatically improves wheel cleaning power without pitting, etching, or hazing the surface of the wheel. After application and removal in a reasonable time period in accordance with the directions on the container.

The present invention uses this dye transfer concept by using polymers to attach to dirt particles and complex it with the polymers for easy removal. These complexed dirt particles can then be easily removed from the wheel during rinsing leaving the wheel clean without scrubbing the wheel surface.

A novel feature of the instant invention is the use of selected polymers such as a polyvinylpyrrolidone, a poly(4-vinylpyridine-betaine), alkylated polyvinylpyrrolidone a poly(N-vinylimidazole, and/or poly(4-vinylpyridine-N-oxide) alone or in combination, together with conventional wheel cleaners, such as an alkaline-based formulation to provide an improved wheel cleaning product. These polymers have been used in the laundry industry to provide dye transfer inhibition benefits. In laundering operations, some colored fabrics have a tendency to release dye into the laundering solutions and the dye can then be transferred onto other fabrics being washed in the same aqueous washing solution. In order to resolve this dye transfer issue, these polymers are used to adsorb the fugitive dyes and complex them before they transfer to other fabrics.

The present invention uses this dye transfer concept by using selected polymers to attach to dirt particles and complex it with the polymers for easy removal. These complexed dirt particles can then be easily removed from the wheel during rinsing leaving the wheel clean without scrubbing the wheel surface.

It is an object of the present invention to provide a cleaning solution which can be used by itself or combined with existing conventional cleaners to remove dirt, brake residue, and road grim from wheel surfaces by application to the wheel by spraying or wiping with a cloth or sponge and simply rinsing the wheel cleaner from the wheel surface with water.

It is an object of the present invention to provide a cleaning solution which is effective without requiring scrubbing.

It is a further object of the present invention to provide a wheel cleaner which is effective and does not leave an insoluble residue.

It is another object of the present invention to provide a wheel cleaning solution which can be used on aluminum, chrome, steel wheels, and painted wheels without damaging the surface.

These an other objects and features of the invention will become apparent to those skilled in the art from the following detailed description and appended claims.

DESCRIPTION OF THE PREFERRED EMBODIMENT

The active ingredients of the present invention are polymers selected from the group comprising a polyvinylpyrrolidone, poly(4-vinylpyridine-betaine), poly(N-vinylimidazole, and/or poly(4-vinylpyridine-N-oxide) alone or together, in combination with conventional wheel cleaners, such as an acid or alkaline-based formulation, and/or detergents, and/or organic solvents to dramatically improve its wheel cleaning power. The polymers complex with the organic or inorganic soil matter and the detergents and/or solvents dissolve and emulsify the soil particles.

The polyvinylpyrrolidone, ("PVP") polymers are available in low medium and high molecular weights. The PVP polymers selected for the instant invention a linear, nonionic polymers having amphiphillic characteristics, and are soluble in water and polar solvents. PVP polymers can be obtained from International Specialty Products. A preferred low molecular weight PVP is available under the trade name of PVP K-15 which has a K-value (viscosity of 1% solution) of 13–19 and a molecular weight in the range of from between 6,000–15,000. A preferred medium molecular weight PVP is available under the trade name of PVP K-30 which has a K-value (viscosity of 1% solution) of 26–35 and a molecular weight in the range of from between 40,000–80,000. Another preferred medium molecular weight PVP is available under the trade name of PVP K-60 which has a K-value (viscosity of 1% solution) of 50–62 and a molecular weight in the range of from between 240,000–400,000. A preferred high molecular weight PVP is available under the trade name of PVP K-90 which has a K-value (viscosity of 1% solution) of 88–100 and a molecular weight in the range of from between 900,000–1,500,000. Another preferred high molecular weight PVP is available under the trade name of PVP K-120 which has a K-value (viscosity of 1% solution) of 108–130 and a molecular weight in the range of from between 2,000,000–3,000,000.

Alkylated polyvinylpyrrolidone, ("PVP") polymers also are effective dirt complexing polymers. International Specialty Products sells allkylated PVPs' under the trade name of GANEX. The allkylated PVP have a relatively low molecular weight and vary in the degree of hydrophobicity. The allkylated PVPs is a copolymer produced from ∝-olefins and vinyl pyrrolidone. The alkyl component varies from a C-4 to C-30 moiety, in concentrations from 10 to 80 percent. For instance GANEX P-904L is a alkylated PVP copolymer consisting of 90% vinyl pyrrolidone and 10% of a $C_4$ ∝-olefins (1-butene). GANEX V-516 is a alkylated PVP copolymer consisting of 50% vinyl pyrrolidone and 50% of an $C_{16}$ ∝-olefins (1-hexadecene). GANEX V-216 is a alkylated PVP copolymer consisting of 20% vinyl pyrrolidone and 80% of a $C_4$ ∝-olefins (1-butene). GANEX V-220 is a alkylated PVP copolymer consisting of 20% vinyl pyrrolidone and 80% of an $C_{20}$ ∝-olefins (1-eicosene). GANEX V-660 is a alkylated PVP copolymer consisting of 20% vinyl pyrrolidone and 80% of an $C_{30}$ ∝-olefins (1-tricosene).

The poly(4-vinylpryidine-N-oxide, ("PVNO"), is more particularly a poly vinyl pyridine-N-oxide, ("PVNO"), is (4-ethenylpyrine, homopolymer, N-oxide) in an aqueous solution. The PVNO is available commercially and distributed in solid form and 40% aqueous solution. The 40% aqueous solution product of PVNO (product containing 40% active ingredient in a water solution), is used in an amount of up to 40% (w/w) level due to commercial cost feasibility, but is not limited to that amount. Experiments with the compound were conducted using levels equivalent to 100% (w.w). The concentrated solution level of a preferred embodiment of the cleaning solution containing the PVNO is effective in an amount which is soluble in water and is typically prepared in a concentration of up to 10.0% and more preferably in a range of from about 0.01 to 2.0% and more preferably in an amount of from between 0.1 to 0.6% (w/w) whereby the concentrate can be further diluted to a 1:3 ratio with water to about 0.2% (w/w) for application to the wheel or other surface to be cleaned therewith.

The poly(4-vinylpyridine-betaine) is also described as a poly(N-carboxymethyl-4-vinylprridinium chloride) sodium salt in water having a molecular formula of $[[C_9H_9O_2N].NaCl]x$. It is an acetic acid, choloro-, sodium salt compound with 4-ethenylpyridine homopolymer. It is also soluble in water and water/alcohol mixtures. A preferred embodiment has a molecular weight range of from between 15,000 and 200,000 (GPC). It is typically used as a dye transfer inhibitor and is a vinylpyridine derivatized with carboxylate functionally to give repeating units of a betaine salt. The concentrated solution level of a preferred embodiment of the cleaning solution containing the PVP betaine is effective in an amount which is soluble in water and is typically prepared in a concentration of up to 10.0% and more preferably in a range of from about 0.01 to 2.0% and more preferably in an amount of from between 0.1 to 0.6% (w/w) whereby the concentrate can be further diluted to a 1:3 ratio with water to about 0.2% (w/w) for application to the wheel or other surface to be cleaned therewith.

Various formulations were provided for purposes of illustrating the invention. It should be understood that these examples are for illustrative purposes only and are not to be constructed as limiting the scope of the invention in any manner. Table 1 shows various wheel cleaning compositions utilizing one or more of the aforementioned selected polymers according to the formulations set forth in Example 1 and 2, and their efficiency of cleaning power as compared to two leading commercial products containing detergents.

Prior to use in the examples a preferred embodiment of the instant cleaning solution product has a concentration of polymer in an effective amount of up to 2.0% (w/w) and more preferably from 0.1 to 2.0% (w/w) and more preferably in a range of from 0.2 to 1.3% (w/w) as set forth in Table 1. All units are in grams.

EXAMPLE 1

Preparation of Wheel Cleaning Compositions

Wheel cleaning compositions were prepared in a routine manner, generally using the following general procedure.

De-ionized water was added to a glass beaker with a magnetic stiffer. With the mixer running, each ingredient was added into the mixture. While order of addition of ingredient is not believed to be critical, the surfactants were added last. Each ingredient was allowed to become completely dispersed prior to the addition of the next ingredient. After the addition of the final ingredient, the mixture is allowed to stir for a period of up to 15 minutes and preferably at least 5 minutes to ensure a homogeneous mixture.

EXAMPLE 2

Cleaning Performance of Various Wheel Cleaning Compositions

Cleaning effectiveness was evaluated by the following method. Each formulation was applied to a dirty wheel using a trigger sprayer and saturating the entire surface. The compositions were allowed to soak for one (1) minute at room temperature without any scrubbing. The wheel was then rinsed with water at normal household water pressure. After rinsing, the wheel surfaces were visually evaluated for cleanness of the wheel. Each cleaning composition was rated on a scale of 1 (no dirt removal) to 5 (complete dirt removal). Three control formulations were also included. Control 1 represents formulation without polymers. Commercial Test Product 1 (an acid base) cleaning product, and Commercial Test Product 2 (an acid based cleaning product), are the current most popular wheel cleaning products on the market.

It should be noted that for test purposes the solution was allowed to remain on the wheel for one minute; however, this time period is not critical, for depending upon the condition of the wheel to be cleaned, the solution can be effective in a matter of seconds and be rinsed off immediately after application. Although the solution could be allowed to remain on the wheel for several minutes, for instance up to five minutes, typically within at least thirty seconds the cleaning composition has dissolved the dirt and is ready for rinsing.

Table 1 lists the components of some of the formulations tested in accordance with the above method. The cleaning ability of each formula was rated on a scale of 1 to 5 with 5 indicating excellent cleaning, and 1 indicating no or little cleaning.

The results indicate that all of the cleaning solutions containing the selected polymers PVP polymers and derivatives thereof in effective amounts as set forth in Table 1 are superior to the results of the control without the polymer and both of the leading commercial products 1 and 2 which do not contain the selected PVP polymers.

Additional conventional cleaning additives such as a ($C_8$–$C_{12}$) quaternary ammonium compound ($Cl^-$) and amphoterics can be used in the formulation such as lauroamphoglycerinatees, betaines, and the like.

Sodium metasilicate anhydrous and/or other silicates can be added to the composition alone or in combination as a scouring agent. Typically the silicates are added to the formulation in effective amounts which enhance cleaning without pitting the surface of levels up to 10 percent by weight and preferably at levels of from 1 to 5 percent by weight and more preferably in levels from 2 to 4 percent by weight.

Moreover, various emulsifiers and dispersing agents can be used such as phosphates, and more particularly such as a tripolyphosphate, a trisodium phosphate, acid phosphates such as mono and disodium phosphates and sodium acid pyrophosphate, and/or a tetrapotassium pyrophosphate, and/or combinations thereof can be used with or in place the sodium metasilicate anhydrous or other silicates in combination with the polymers set forth herein to obtain an alternate embodiment of the present invention. The phosphates and other emulsifiers such as sodium citrate are typically used in effective amounts of up to 10 percent by weight, and more preferably from about 0.1 to 5 percent by weight.

In addition to the above-mentioned PVP compounds, it is anticipated that chloride in the form of nonionic surfactants having a formulation with a $Cl^-$ and containing from 8 to 12 carbons can also be utilized as a preferred cleaning composition utilizing nonionic surfactants. Surfactants useful in the present invention include those of which R is the linear primary alcohol and n is the total number of moles of ethylene oxide in accordance with the following formula:

$$RO(CH_2CH_2O)_nH$$

Wherein R comprises a:

Linear $C_8$ $C_9$ $C_{10}$ $C_{11}$ $C_{12}$ Poly(2) or (4) or (6) or (8) oxyethylene $C_{8-12}$ alcohol;

Linear $C_9$ $C_{10}$ $C_{11}$ Poly(2.5) or (6) or (8) oxyethylene $C_{9-11}$ alcohol;

TABLE I

| Ingredients | A | B | C | D | E | Ctrl 1 | Acid base Samp 2 | Acid base Samp 3 |
|---|---|---|---|---|---|---|---|---|
| Water | 87.0 | 87.0 | 87.0 | 87.0 | 87.0 | 88.0 | Commercial product 1 | Commercial product 2 |
| Sodium EDTA | 2.0 | 2.0 | 2.0 | 2.0 | 2.0 | 2.0 | | |
| Na Metasilicate Pentahydrate | 3.0 | 3.0 | 3.0 | 3.0 | 3.0 | 3.0 | | |
| Non-ion/cationic surfactants | 7.0 | 7.0 | 7.0 | 7.0 | 7.0 | 7.0 | | |
| Polyvinylpyrrolidone (low mwt. 6,000–15,000) | 1.0 | | | | | | | |
| Polyvinylpyrrolidone (mid. mwt. 40,000–80,000) | | 1.0 | | | | | | |
| Polyvinylpyrrolidone (high mwt. 900000–1500000) | | | 1.0 | | | | | |
| Poly(4-vinylpyridine betaine) | | | | 1.0 | | | | |
| Poly(4-vinylpyridine-N-oxide) | | | | | 1.0 | | | |
| CLEANING RATING | 5.0 | 5.0 | 4.0 | 5.0 | 5.0 | 2.0 | 2.0 | 3.0 |

Linear $C_{11}$ Poly(3) or (5) or (7) oxyethylene $C_{11}$ alcohol;

Linear $C_{12}/C_{13}$ Poly(1) or (3) or (5) or (6.5) oxyethylene $C_{12-13}$ alcohol;

Linear $C_{12}$ $C_{13}$ $C_{14}$ $C_{15}$ Poly(3) or (7) or (9) or (12) oxyethylene $C_{12-15}$ alcohol; and/or Linear $C_{14}/C_{15}$ Poly(2.5) or (7) or (13) oxyethylene $C_{14-15}$ alcohol.

Moreover, amine oxides, nonyl phenol ethoxylate, ethoxylated alcohols, ethoxylate propoxylated block copolymers and diethanolamides may be used in the present invention.

It is also contemplated that the aforementioned polymers ((polyvinylpyrrolidone, poly(4-vinylpyridine-betaine), poly (N-vinylimidazole, alkylated polyvinylpyrrolidone and/or poly(4-vinylpyridine-N-oxide) alone or together can be combined with an acid or alkaline based cleaning formulation.

Acid cleaners which may be used together with the polymers of the instant invention and include acids such as phosphoric, hydrochloric, sulfuric, oxalic, acetic, nitric, hydroxyacetic, hydrofluoric, and citric acids and combinations thereof.

Alkaline cleaners which may be used together with the polymers of the instant invention include detergents, water soluble organic solvents such as glycol ether, alkaline compositions such as sodium hydroxide, potassium hydroxide, and /or any of the alkaline silicates and phosphates.

Suitable detergents capable of dissolving and emulsifying organic soils include, but are not limited to anionic synthetic detergents such as alkyl sulfates such as sodium lauryl sulfate, alkyl ether sulfates, and linear alkyl benzene sulfonates. The amount of detergents used in the composition is not critical so long as it remains soluble in an aqueous solution and is capable of dissolving and emulsifying organic soils. The amount of detergent used typically depends on the amount used. For example, nonionic detergents can be used in amounts of up to 40 percent by weight. Anionic synthetic detergents can be used in amounts up to 30 percent by weight.

Organic solvents which can be used in with the polymers of the instant invention include, but are not limited to glycols such as ethylene and propylene glycol, glycol ethers, hydrocarbons, alcohols, n-methyl pyrrolidone, ketones, lactones, and terpenes such as d-limonene. The organic solvents can be used in amounts of up to 50% by weight.

Chelating agents such as ethylenediaminetetraacetic acid ("EDTA") such as sold by the trade name VERSENE 100 may be used to aid in the removal of insoluble deposits of calcium and magnesium soaps and/or as a scouring agent. Moreover a number of salts of EDTA sometimes referred to as edetates are available such as calcium disodium, disodium edetates, tetrasodium, trisodium sodium ferric, dihydrogen ferrous and other disodium salts containing magnesium, cobalt manganese, copper, zinc, and nickel.

Cationic and nonionic surfactants such as BEROL 226 by Akzo Nobel Chemicals which contains a polyethoxylated quaternary ammonium surfactant and nonionic surfactants such as PLUROFAC D25 can be utilized in the present formulation in effective amounts of up to 10 percent by weight, and more preferably in amounts from 0.01 to 5.0 percent and more preferably from 0.01 to 3.0 percent.

ELFACOS CD481 (1%) is a viscosity thickener which can be utilized in the present formulation in effective amounts of up to 10 percent by weight, and more preferably in amounts from 0.01 to 5.0 percent and more preferably from 0.1 to 3.0 percent.

A scouring agent such as sodium metasilicate pentahydrate, sodium metasilicate anhydrous, silicates can be incorporated into the instant composition in effective amounts of up to 10 percent by weight, and more preferably in amounts from 0.01 to 5.0 percent and more preferably from 0.1 to 3.0 percent.

Dispersing agents and emulsifiers such as a trisodium phosphate, a tetrapotassium pyrophosphate, sodium tripolyphosphate, sodium citrate, and acid phosphates such as mono and disodium phosphate and sodium acid pyrophosphate compounds can be used in effective amounts of up to 10 percent by weight, and more preferably in amounts from 0.01 to 5.0 percent and more preferably from 0.1 to 3.0 percent.

BITREX or other additives may be added to the formulation in an effective amount to add a bitter taste to the composition. Terpenes such as limonene may be added in an effective amount to enhance the fragrance of the product. The following examples utilize the polymers of the present invention together with conventional cleaning constituents.

EXAMPLE 3

Cleaning Performance of Various Wheel Cleaning Compositions

| Component | Weight in Grams |
|---|---|
| PVP (10% solution) | 8.64 |
| Water | 68.86 |
| VERSENE 100 (ethylenediaminetetraacetic acid | 3.20 |
| Sodium Metasilicate Pentahydrate | 2.4 |
| BEROL 226 (surfactant) | 7.2 |
| Isopropyl Alcohol | 4.9 |

The composition set forth in Example 3 resulted in a clean wheel without residue.

EXAMPLE 4

Cleaning Performance of Various Wheel Cleaning Compositions

| Component | Weight in Grams |
|---|---|
| PVP (10% solution) | 1.08 |
| Water | 76.92 |
| VERSENE 100 (ethylenediamininetetraacetic acid) | 4.0 |
| Sodium Metasilicate Pentahydrate | 3.0 |
| BEROL 226 (surfactant) | 9.0 |
| Isopropyl Alcohol | 6.0 |

The composition set forth in Example 4 resulted in a clean wheel, but the results were not as good as those with the formulation of Example 3.

EXAMPLE 5

Cleaning Performance of Various Wheel Cleaning Compositions

| Component | Weight in Grams |
|---|---|
| PVP (10% solution) | 8.64 |
| Water | 73.76 |
| VERSENE 100 (ethylenediaminetetraacetic acid) | 3.2 |

-continued

| Component | Weight in Grams |
|---|---|
| Sodium Metasilicate Pentahydrate | 2.4 |
| BEROL 226 (surfactant) | 7.2 |

The composition set forth in Example 5 resulted in a clean wheel without residue indicating that the addition of isopropyl alcohol has a negligible effect if any on the final products at the levels used in Example 3.

EXAMPLE 6

Cleaning Performance of Various Wheel Cleaning Compositions

| Component | Weight in Grams |
|---|---|
| PVNO (40% solution) | 2.5 |
| Water | 67.2 |
| VERSENE 100 (ethylenediaminetetraacetic acid) | 4.0 |
| Sodium Metasilicate Pentahydrate | 3.0 |
| BEROL 226 (surfactant) | 9.0 |
| ELFACOS CD481 (1%) viscosity thickener | 5.0 |

The composition set forth in Example 6 exhibited very good cleaning power.

EXAMPLE 7

Cleaning Performance of Various Wheel Cleaning Compositions

| Component | Weight in Grams |
|---|---|
| PVNO (40% solution) | 0.6 |
| Water | 85.4 |
| VERSENE 100 (ethylenediaminetetraacetic acid) | 4.0 |
| Sodium Metasilicate Pentahydrate | 3.0 |
| BEROL 226 (surfactant) | 7.0 |

The composition set forth in Example exhibited very good cleaning power and is equivalent to that in Example 3.

EXAMPLE 8

Cleaning Performance of Various Wheel Cleaning Compositions

| Component | Weight in Grams |
|---|---|
| PVP (10% solution) | 2.5 |
| Water | 67.2 |
| VERSENE 100 (ethylenediaminetetraacetic acid) | 4.0 |
| Sodium Metasilicate Pentahydrate | 3.0 |
| BEROL 226 (surfactant) | 9.0 |
| ELFACOS CD 481 (1%) | 5.0 |

The composition set forth in Example 8 resulted in a clean wheel without residue.

EXAMPLE 9

Cleaning Performance of Various Wheel Cleaning Compositions

| Component | Weight in Grams |
|---|---|
| PVP (10% solution) | 0.6 |
| Water | 85.4 |
| VERSENE 100 (surfactant) | 4.0 |
| Sodium Metasilicate Pentahydrate | 3.0 |
| BEROL 226 | 7.0 |

The composition set forth in Example 9 resulted in a clean wheel.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

We claim:

1. A wheel cleaning composition comprising an effective amount of a dirt complexing polymer, to complex with dirt particles, selected from the group consisting of a polyvinylpyrrolidone, a poly(4-vinylpyridine-betaine), a poly(N-vinylimidazole, a poly(4-vinylpyridine-N-oxide), and combinations thereof;

a silicate scouring agent a nonionic surfactant; and a polyethoxylated quaternary ammonium cationic surfactant.

2. The wheel cleaning composition of claim 1, including an additional nonionic surfactant or cationic surfactant.

3. The wheel cleaning composition of claim 1, wherein said nonionic or cationic surfactant is selected from the group consisting of BEROL 226, PLUROFAC D25, and combinations thereof.

4. The wheel cleaning composition of claim 1, wherein the nonionic surfactant contains from 8 to 12 carbons of which R is the linear primary alcohol and n is the total number of moles of ethylene oxide in accordance with the formula $RO(CH_2CH_2O)_nH$ wherein R is selected from the group consisting of a linear $C_8$ $C_9$ $C_{10}$ $C_{11}$ $C_{12}$ Poly(2) or (4) or (6) or (8) oxyethylene $C_{8-12}$ alcohol; linear $C_9$ $C_{10}$ $C_{11}$ Poly(2.5) or (6) or (8) oxyethylene $C_{9-11}$ alcohol; linear $C_{11}$, Poly(3) or (5) or (7) oxyethylene $C_{11}$ alcohol; linear $C_{12}/C_{13}$ Poly(1) or (3) or (5) or (6.5) oxyethylene $C_{12-13}$ alcohol; linear $C_{12}$ $C_{13}$ $C_{14}$ $C_{15}$ Poly(3) or (7) or (9) or (12) oxyethylene $C_{12-15}$ alcohol; and linear $C_{14}/C_{15}$ Poly(2.5) or (7) or (13) oxyethylene $C_{14-15}$ alcohol.

5. The wheel cleaning composition of claim 1, wherein the nonionic surfactant is selected from the group consisting of an amine oxide, a nonyl phenol ethoxylate, an ethoxylated alcohol, and ethoxylate propoxylated block co-polymer, and a diethanolamide.

6. The wheel cleaning composition of claim 1, further comprising a conventional wheel cleaning agent comprising an acid-based formulation.

7. The wheel cleaning composition of claim 6, wherein said acid-based formulation includes an acid cleaner selected from the group consisting of a phosphoric, a hydrochloric, a sulfuric, an oxalic, an acetic, a nitric, a hydroxyacetic, a hydrofluoric, a citric acid, and combinations thereof.

8. The wheel cleaning composition of claim 1, further comprising a conventional wheel cleaning agent comprising an alkaline-based formulation.

9. The wheel cleaning composition of claim 8, wherein said alkaline-based formulation is an alkaline cleaner, is present in an effective amount for dissolving and emulsifying organic soils, and is selected from the group consisting of a detergent, a water soluble organic solvent, a glycol ether, a sodium hydroxide solution, a potassium hydroxide solution, an alkaline silicate, an alkaline phosphate, and combinations thereof.

10. The wheel cleaning composition of claim 1, further comprising an anionic detergent.

11. The wheel cleaning composition of claim 10, wherein said anionic detergent is an alkyl sulfate.

12. The wheel cleaning composition of claim 10, wherein said detergent is selected from the group consisting of a sodium lauryl sulfate, an alkyl ether sulfate, a linear alkyl benzene sulfonate, and combinations thereof.

13. The wheel cleaning composition of claim 9, wherein said alkaline cleaner is present in an amount of up to 40 percent by weight.

14. The wheel cleaning composition of claim 1, further comprising an organic solvent in an amount of up to 50% by weight.

15. The wheel cleaning composition of claim 14, wherein said organic solvents are selected from the group consisting of an ethylene glycol, a propylene glycol, a glycol ether, a hydrocarbon, an alcohol, a n-methyl pyrrolidone, a ketone, a lactone, a terpene, and combinations thereof.

16. The wheel cleaning composition of claim 15, wherein said terpene is a limonene.

17. The wheel cleaning composition of claim 1, further comprising a chelating agent for aiding in the removable of insoluble deposits of calcium and magnesium soaps and salts thereof.

18. The wheel cleaning composition of claim 17 wherein said chelating agent is ethylenediaminetetraacetic acid ("EDTA") and salts thereof.

19. The wheel cleaning composition of claim 18, wherein said salts of EDTA are selected from the group consisting of calcium disodium edetate, disodium edetate, tetrasodium edetate, trisodium edetate, sodium ferric edetate, and dihydrogen ferrous edetate.

20. The wheel cleaning composition of claim 17 wherein said chelating agent comprises a salt of magnesium, cobalt, manganese, copper, zinc, and nickel.

21. The wheel cleaning composition of claim 2 wherein said cationic surfactant, said nonionic surfactant, or a combination thereof is present in an amount of up to 20 percent by weight.

22. The wheel cleaning composition of claim 2 wherein said cationic surfactant, said nonionic surfactant, or a combination thereof is present in an amount of up to 0.01 to 5.0 percent by weight.

23. The wheel cleaning composition of claim 1 including at least one additional scouring agent.

24. The wheel cleaning composition of claim 1, wherein said silicate scouring agent is selected from the group consisting of sodium metasilicate pentahydrate, and sodium metasilicate anhydrous, in an amount of up to 10 percent by weight.

25. The wheel cleaning composition of claim 24 wherein said scouring agent is present in an amount of 0.1 to 3.0 percent by weight.

26. The wheel cleaning composition of claim 24 wherein said scouring agent is present in an amount of from between 0.01 and 5.0 percent by weight.

27. The wheel cleaning composition of claim 1 further comprising a dispersing and emulsifying agent.

28. The wheel cleaning composition of claim 27 wherein said dispersing and emulsifying agent is selected from the group consisting of trisodium phosphate, tetrapotassium pyrophosphate, sodium tripolyphosphate, sodium citrate, monosodium phosphate, disodium phosphate, sodium acid pyrophosphate, and combinations thereof.

29. The wheel cleaning composition of claim 28 wherein said dispersing and emulsifying agent is present in an amount of up to 10.0 percent by weight.

30. The wheel cleaning composition of claim 28 wherein said dispersing and emulsifying agent is present in an amount of between 0.01 to 5.0 percent by weight.

31. The wheel cleaning composition of claim 1 further comprising a effective amount of a compound to effect a bitter taste to the composition.

32. The wheel cleaning composition of claim 31 wherein said compound to effect a bitter taste to the composition is BITREX.

33. The wheel cleaning composition of claim 1 further comprising a viscosity thickener.

34. The wheel cleaning composition of claim 33 wherein said viscosity thickener is present in an amount of up to 5.0 percent by weight.

35. The wheel cleaning composition of claim 33, wherein said viscosity thickener is ELFACOS CD481 (1%).

36. The wheel cleaning composition of claim 1, wherein said polyvinylpyrrolidone comprises a molecular weight in the range of from between 6,000–15,000.

37. The wheel cleaning composition of claim 1, wherein said polyvinylpyrrolidone comprises a molecular weight in the range of from between 40,000–80,000.

38. The wheel cleaning composition of claim 1, wherein said polyvinylpyrrolidone comprises a molecular weight in the range of from between 240,000–400,000.

39. The wheel cleaning composition of claim 1, wherein said polyvinylpyrrolidone comprises a molecular weight in the range of from between 6.000–15,000.

40. The wheel cleaning composition of claim 1, wherein said polyvinylpyrrolidone comprises a molecular weight in the range of from between 900,000–1,500,000.

41. The wheel cleaning composition of claim 1, wherein said polyvinylpyrrolidone comprises a molecular weight in the range of from between 2,000,000–3,000,000.

42. The wheel cleaning composition of claim 1, wherein an alkylated polyvinylpyrrolidone is selected from the group consisting of GANEX P-904L which is an alkylated PVP copolymer comprising 90% vinyl pyrrolidone and 10% of a $C_4$ olefins (1-butene), GANEX V-516 which is an alkylated PVP copolymer comprising of 50% vinyl pyrrolidone and 50% of a $C_{16}$ olefins (1-hexadecene), GANEX V-216 which is an alkylated PVP copolymer comprising 20% vinyl pyrrolidone and 80% of a $C_4$ olefins (1-butene), GANEX V-220 which is an alkylated PVP copolymer comprising 20% vinyl pyrrolidone and 80% of a $C_{20}$ olefins (1-eicosene), GANEX V-660 which is an alkylated PVP copolymer comprising 20% of a vinyl pyrrolidone and 80% of a $C_{30}$ olefins (1-tricosene), and combinations thereof.

43. The wheel cleaning composition of claim 1, wherein said poly(4-vinylpyridine-N-oxide) is in a 40% aqueous solution, (product containing 40% active ingredient in a water solution).

44. The wheel cleaning composition of claim 1, wherein said poly(4-vinylpyridine-betaine) has a molecular weight range of from between 15,000 and 200,000 (GPC).

45. The wheel cleaning composition of claim 1, including a cleaning additive selected from the group comprising lauroamphoglycerinates and betaines.

46. The wheel cleaning composition of claim 23, wherein said at least one additional scouring agent is present in an amount of up to 10.0 percent by weight.

47. The wheel cleaning composition of claim 23, wherein said at least one additional scouring agent is present in an amount of up to 0.1 to 5.0 percent by weight.

48. The wheel cleaning composition of claim 1, wherein said composition is prepared in a concentrate of from 0.01 to 10.0% (w/w) and diluted with water to less than 1% (w/w) for application to the surface of the wheel or tire.

49. The wheel cleaning composition of claim 48, wherein said composition is prepared in a concentrate of from 0.01 to 10.0% (w/w) and diluted to a 1:3 ratio with water.

50. The wheel cleaning composition of claim 1, wherein said composition is prepared in a concentrate of from 0.01 to 2.0% (w/w) and diluted with water to less than 1% (w/w) for application to the surface of the wheel or tire.

51. The wheel cleaning composition of claim 1, wherein said composition is prepared in a concentrate of from 0.01 to 2.0% (w/w) and diluted with water to between 0.1 to 0.5% (w/w) for application to the surface of the wheel or tire.

52. A wheel cleaning composition, comprising an effective amount of a dirt complexing polymer, to complex with dirt particles, selected from the group consisting of a polyvinylpyrrolidone, a poly(4-vinylpyridine-betaine), a poly(N-vinylimidazole, a poly(4-vinylpyridine-N-oxide), and combinations thereof;

a nonionic surfactant;

a polyethoxylated quaternary ammonium surfactant;

a silicate scouring agent;

a chelating agent; and water.

53. The wheel cleaning composition of claim 52, wherein said chelating agent is ethylenediaminetetraacetic acid or salt thereof in an amount of from between 0.01 to 20.0 percent by weight.

54. The wheel cleaning composition of claim 52, wherein said silicate scouring agent is sodium metasilicate pentahydrate in an amount of from between 0.01 and 10 percent by weight.

55. The wheel cleaning composition of claim 52, further comprising a polar solvent comprising an alcohol in an amount of up to 50 percent by weight.

56. The wheel cleaning composition of claim 52, said chelating agent comprising a salt of ethylenediaminetetraacetic acid selected from the group consisting of calcium disodium edetate, disodium edetate, tetrasodium edetate, trisodium edetate, sodium ferric edetate, dihydrogen ferrous edetate, disodium salt containing magnesium, disodium salt containing cobalt, disodium salt containing manganese, disodium salt containing copper, disodium salt containing zinc, and disodium salt containing nickel for aiding in the removable of insoluble deposits of calcium and magnesium soaps and salts thereof.

57. A method of preparing a wheel cleaning composition comprising the steps of:

preparing a solution of water in a container;

agitating said solution;

selecting an effective amount of a dirt complexing polymer selected from the group consisting of a polyvinylpyrrolidone, a poly(4-vinylpyridine-betaine), a poly (N-vinylimidazole, a poly(4-vinylpyridine-N-oxide), and combinations thereof and adding same to said solution dispersing same;

adding a scouring agent comprising a sodium metasilicate pehtahydrate and a chelating agent to said solution dispersing same;

adding a nonionic and polyethoxylated quaternary ammonium cationic surfactant to said solution dispersing same;

agitating said solution obtaining a homogenous wheel cleaning composition mixture.

58. The wheel cleaning composition of claim 57, including the step of adding a chelating agent and dispersing same for aiding in the removable of insoluble deposits of calcium and magnesium soaps and salts thereof.

59. The wheel cleaning composition of claim 58 wherein said chelating agent is ethylenediaminetetraacetic acid ("EDTA") and salts thereof.

60. The method of preparing a wheel cleaning composition, of claim 57, further comprising the step of selecting an effective amount of an acid-based formulation in an aqueous solution.

61. A method of cleaning a wheel comprising the steps of:

preparing a solution of water in a container;

agitating said solution;

selecting an effective amount of a dirt complexing polymer selected from the group consisting of a polyvinylpyrrolidone, a poly(4-vinylpyridine-betaine), a poly (N-vinylimidazole, a poly(4-vinylpyridine-N-oxide), and combinations thereof and adding same to said solution dispersing same;

adding a scouring agent comprising a sodium metasilicate pehtahydrate and a chelating agent comprising an ethylenediaminetetraacetic acid to said solution dispersing same;

adding a nonionic and cationic surfactant to said solution dispersing same;

agitating said solution obtaining a homogenous wheel cleaning composition mixture;

applying said composition to a wheel of a vehicle;

wiping with a cloth or sponge; and rinsing said wheel or tire with water.

62. The method of cleaning a wheel comprising the steps set forth in claim 61 wherein said wheel comprises aluminum, chrome, stainless steel, painted steel, painted aluminum, clear coated aluminum, plastic, fiberglass, and rubber.

63. The wheel cleaning composition of claim 55 wherein said polar solvent comprises an ethylene glycol, a propylene glycol, a glycol ether, a hydrocarbon, an alcohol, a n-methyl pyrrolidone, a ketone, a lactone, a terpene, and combinations thereof.

64. The method of claim 61, wherein said cationic surfactant comprises a polyethoxylated quaternary ammonium surfactant.

* * * * *